US009476185B2

(12) United States Patent
Clark

(10) Patent No.: US 9,476,185 B2
(45) Date of Patent: Oct. 25, 2016

(54) POND WATER DIVERSION APPARATUS FOR FLOOD CONTROL AND PREVENTION OF CASTOR INFESTATION

(71) Applicant: James Edward Clark, Carrollton, MS (US)

(72) Inventor: James Edward Clark, Carrollton, MS (US)

( * ) Notice: Subject to any disclaimer, the term of this patent is extended or adjusted under 35 U.S.C. 154(b) by 0 days.

(21) Appl. No.: 14/691,680

(22) Filed: Apr. 21, 2015

(65) Prior Publication Data

US 2015/0299972 A1 Oct. 22, 2015

Related U.S. Application Data

(60) Provisional application No. 61/981,866, filed on Apr. 21, 2014.

(51) Int. Cl.
*E02B 3/02* (2006.01)
*E03B 3/04* (2006.01)

(52) U.S. Cl.
CPC ..... *E03B 3/04* (2013.01)

(58) Field of Classification Search
CPC ..... E02B 3/00; E02B 3/02; E03B 3/04; E03F 7/06
See application file for complete search history.

(56) References Cited

U.S. PATENT DOCUMENTS

| | | | | |
|---|---|---|---|---|
| 4,224,156 | A * | 9/1980 | Pardikes | B01D 21/01 210/123 |
| 4,494,395 | A | 1/1985 | Brettbacher | |
| 4,797,028 | A * | 1/1989 | Jamieson | E02B 7/18 137/132 |
| 4,998,847 | A * | 3/1991 | Thurber | E01F 5/005 210/164 |
| 5,405,217 | A | 4/1995 | Dias | |
| 5,820,751 | A * | 10/1998 | Faircloth, Jr. | B01D 21/2444 210/122 |
| 6,413,015 | B1 * | 7/2002 | Poirier | E01F 5/005 210/170.03 |
| 7,232,728 | B1 | 6/2007 | Lee | |
| 7,762,741 | B1 | 7/2010 | Moody | |
| 7,985,035 | B2 * | 7/2011 | Moody | E03F 5/105 137/578 |
| 8,672,585 | B2 | 3/2014 | Schnaars, Sr. | |
| 2003/0121850 | A1 | 7/2003 | Use | |

FOREIGN PATENT DOCUMENTS

| | | | |
|---|---|---|---|
| WO | 2010132267 | A2 | 11/2010 |
| WO | 2013107449 | A1 | 7/2013 |

* cited by examiner

*Primary Examiner* — Benjamin Fiorello
(74) *Attorney, Agent, or Firm* — Cooley LLP

(57) ABSTRACT

An apparatus for water level management in bodies of water is provided herein. Further, a method of controlling beaver infestation in bodies of water is also provided.

15 Claims, 15 Drawing Sheets

FIG. 10
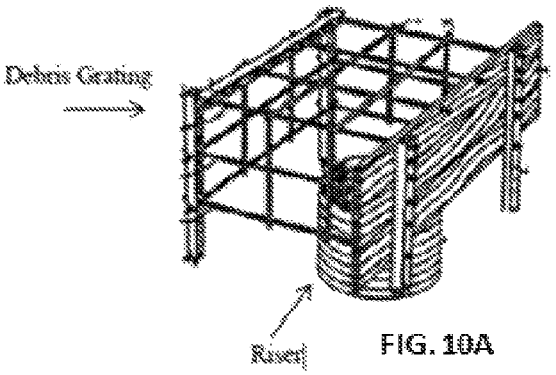
FIG. 10A
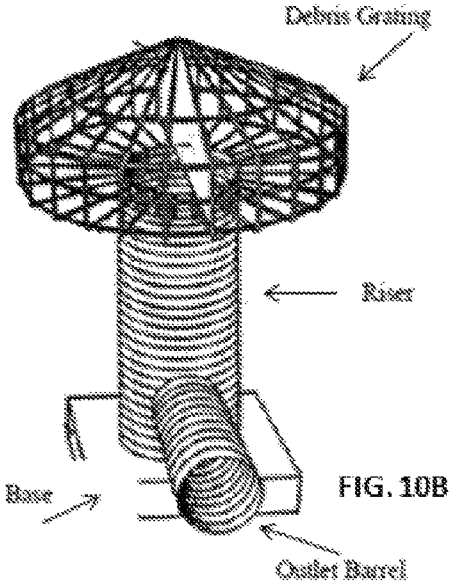
FIG. 10B
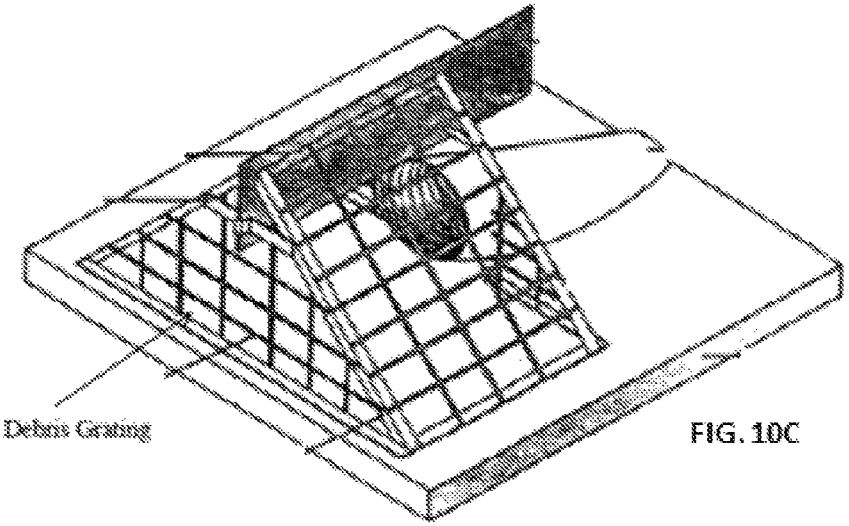
FIG. 10C

POND WATER DIVERSION APPARATUS FOR FLOOD CONTROL AND PREVENTION OF CASTOR INFESTATION

CROSS REFERENCE TO RELATED APPLICATIONS

The present application claims the benefit of priority to U.S. Provisional Application No. 61/981,866, filed on Apr. 21, 2014, the entire contents of which are hereby incorporated by reference in their entirety for all purposes.

FIELD

The present disclosure relates to the field of water management and in particular to apparatuses and methods that are useful for managing water levels in bodies of water.

The apparatuses and methods taught herein find particular applicability in the field of managing water levels in small bodies of water to prevent flooding and Castor infestation.

BACKGROUND

The management of appropriate water levels in small bodies of water is normally accomplished via the use of water drainage structures, comprising: a baffle, riser, anchoring base, and discharge pipe.

These devices allow surface water to enter the drainage structure via the water surface and into the baffle and subsequently through the riser and out the discharge pipe. Often, the discharge pipe deposits the excess water through and onto the other side of an earthen dam system and into a drainage creek or wetland flood area.

The appropriate level of water in these systems is maintained by setting the riser at a predetermined height. The height of the riser determines the level at which surface water may enter the drainage structure.

The importance of maintaining the appropriate water level, via utilization of water drainage systems, is paramount for managing the water body for its intended use, i.e. flood control, water treatment, recreation, wetland management, agricultural resource utilization, etc.

For instance, in bodies of water small enough to be termed "ponds," water depth affects: algae growth, aquifer contamination, water stratification, fish survival, sedimentation, and flood control. See, Cronk & Fennessy, *Wetland Plants Biology and Ecology*, Lewis Publishers. 2001; and also. Begon, et al., *Ecology: Individuals, Populations, and Communities*, Blackwell Scientific Publications, 2$^{nd}$ Edition, 1990, each of which are incorporated by reference herein in their entireties for all purposes.

For managing pond water levels for agriculture application, a water depth of at least six or seven feet is often needed to insure adequate water during dry periods. Further, to reduce widespread attached aquatic plant growth problems, a pond depth of at least four feet is often desired. This depth will generally prevent the growth of attached aquatic plants in clean ponds. Many emergent plants require water depths of less than six inches, while submerged plants typically require water one to two feet deep. Deep ponds will therefore restrict plant growth. A water depth of about six feet over the major portion of the pond will also increase winter survival of fish.

Despite the known importance of managing pond water depth, there remain significant obstacles that prevent land managers from appropriately controlling the depth of ponds. In particular, the clogging of water drainage systems by: (1) abiotic debris and (2) beaver (*Castor* sp.) infestation are two of the most pernicious problems faced by land managers attempting to maintain an appropriate and consistent pond water level.

To combat these two issues, land managers and engineers have developed elaborate surface water screening mechanisms that attempt to prevent abiotic debris congestion. For example, the structures represented by FIG. 10 are available in the industry and provide a physical barrier (i.e. debris grating) that is supposed to mitigate the effects of debris buildup. In theory, the surface water physical barrier provides enough distance between itself and the entrance into the riser that water is still able to freely flow through the riser and out through the drainage structure. However, these devices are often ineffective, as the buildup of debris becomes too large and dense to effectively allow the passage of water into the riser.

Also, the surface water devices aimed at preventing debris buildup from entering the water drainage system have little to no effect on the problems caused by beaver infestation.

Beavers are attracted to an area and stimulated to build dams by two main environmental cues: (1) active surface water current, and (2) the sound of falling or trickling water.

Beavers can detect surface water current flow and are attracted to active surface current. Thus, the typical water drainage systems utilized in the art, even if equipped with a surface water debris grate, or physical barrier, to prevent debris from clogging the riser, do not address the main attractant of the beaver, i.e. surface water movement. Rather, these structures can often exacerbate a beaver problem, by creating fast surface current flow.

A second stimulus that causes beavers to build dams and clog drainage systems is the sound of falling or trickling water, which are present with the drainage systems of the art.

Thus, the pond water control devices and drainage systems present in the art are ineffective in combating: (1) natural abiotic debris cloggage of the riser and also (2) biotic assisted cloggage of the riser caused by beaver dams.

The surface water inlets found in the drainage systems of the art are not only ineffective in ameliorating beaver infestations, but they are actually potent attractants of the beaver, as these structures create and amplify the sound of falling water and also create observable surface water movement.

An effective water management device is therefore drastically needed in the art to solve the problem of effective water level control that is not hampered by debris buildup and beaver infestations.

BRIEF SUMMARY

The present disclosure solves the problems present in the art and provides an effective water level management device that is not susceptible to debris cloggage and that alleviates the problems presented by beaver infestation.

In one embodiment, the disclosure provides for a water level management device that is suitable for use in a small body of water or pond. In other embodiments, the water level management device is suitable for use in larger bodies of water or lakes.

In an embodiment, the disclosed water level management device is termed a diverter. In a particular embodiment, the disclosed apparatus is termed "Clark's Diverter."

In an embodiment, the water diverter apparatus is affixed to the top of a drop pipe or riser. In another embodiment, the diverter apparatus is affixed to the top of a baffle, and the baffle is affixed atop of a drop pipe or riser.

In an embodiment, the diverter apparatus is effective at preventing abiotic debris from clogging the riser or drop pipe.

In an embodiment, the diverter apparatus is effective at preventing beavers from clogging the riser or drop pipe.

Thus, in embodiments, the diverter apparatus allows water to freely flow from the water body down into the riser and out a water discharge pipe.

In aspects, the diverter apparatus requires little to no maintenance once it is installed.

In an aspect, the diverter apparatus causes water from the bottom of the water body to enter the device, rather than apparatuses of the prior art that allow surface water to enter the water drainage device.

Thus, in embodiments, the water diverter apparatus is affixed atop a baffle, which is itself located atop a riser/drop pipe, that leads to a water discharge pipe. In this embodiment, water enters the diverter apparatus from the bottom and flows upward into the riser. Because the water is entering the diverter from the bottom and flowing into the riser while contained in the diverter apparatus, there is no surface water movement or noise to attract beavers. Further, because the water is entering the diverter apparatus from the bottom and not the water's surface there is no buildup of debris at the riser entrance.

In particular aspects, the diverter apparatus can be installed on existing drop pipes. That is, the diverter apparatus, in particular embodiments, can be designed to sit atop existing baffles and drop pipes much like a metal tubular "cap." However, the water diverter apparatus must be open on at least the end distal to the water body's surface and can also be open on the end proximal to the water body's surface. The water diverter causes water to flow into the device from near the pond's bottom and then subsequently into the existing baffle and drop pipe structure. The diverter apparatus can be installed on existing drop pipes by utilizing a groove on the underside of the diverter, on the end proximal to the water body's surface, which causes the diverter to "snap" to the existing baffle or riser/drop pipe.

In some embodiments, the bottom of the water diverter (i.e. the end of the diverter distal to the water body's surface) is located within 1 foot of a pond's bottom, or within 2 feet of the pond's bottom, or within 3 feet of the pond's bottom, or within 4 feet of the pond's bottom, or within 5 feet of the pond's bottom, or within 10 feet of the pond's bottom, or within 10 feet or more from the pond's bottom.

In some embodiments, the bottom of the water diverter (i.e. the end of the diverter distal to the water body's surface) is located at a distance from the pond's bottom that is sufficient to allow for water to pass into the diverter apparatus, but not so close to the pond's bottom so as to cause silt or mud from the pond's bottom to prevent water flow into the apparatus.

In some embodiments, the bottom of the water diverter (i.e. the end of the diverter distal to the water body's surface and thus below the water's surface) is located within 1 foot of a pond's surface, or within 2 feet of the pond's surface, or within 3 feet of the pond's surface, or within 4 feet of the pond's surface, or within 5 feet of the pond's surface, or within 10 feet of the pond's surface, or within 10 feet or more from the pond's surface.

In particular aspects, the water diverter apparatus does not cause whirlpools at the water's surface, as it is drawing water into the device from near the pond's bottom, or drawing water into the device at a sufficient depth from the water's surface, so as not to create a surface whirlpool. Consequently, the diverter apparatus does not attract beavers, as there is no whirlpool effect at the water's surface.

In aspects, the water diverter apparatus has a diameter that is at least as large as the diameter of the drop pipe/riser. In other aspects, the diverter has a diameter that is slightly larger than the diameter of the riser, such that water can flow from the bottom of the water diverter up to the top and over into the riser. In some aspects, the drop pipe/riser has a diameter of at least about 12 inches, or at least about 18 inches, or at least about 24 inches, or at least about 30 inches, or at least about 36 inches, or at least about 42 inches, or at least about 48 inches, or at least about 54 inches, or at least about 60 inches, or at least about 66 inches, or at least about 72 inches, or larger. Thus, in some aspects, the water diverter apparatus has a diameter of at least about 12 inches, or at least about 18 inches, or at least about 24 inches, or at least about 30 inches, or at least about 36 inches, or at least about 42 inches, or at least about 48 inches, or at least about 54 inches, or at least about 60 inches, or at least about 66 inches, or at least about 72 inches, or larger. The water diverter apparatus can be of any diameter and is customizable to fit the size of the drop pipe/rise.

Further, the water diverter apparatus can be of any length, and is customizable to ensure that the aperture of the water diverter apparatus below the water's surface is at the desired level for water intake. In an aspect, the water diverter apparatus is at least about 1 foot long, or at least about 2 feet long, or at least about 3 feet long, or at least about 4 feet long, or at least about 5 feet long, or at least about 6 feet long, or at least about 7 feet long, or at least about 8 feet long, or at least about 9 feet long, or at least about 10 feet long, or at least about 11 feet long, or at least about 12 feet long, or from 12-24 feet long, or longer.

In an embodiment, the diverter has a diameter that is from 1.5× larger than the diameter of the riser. In other embodiments, the diverter has a diameter that is 2× larger than the diameter of the riser. In other embodiments, the diverter has a diameter that is 3× larger, 4× larger, 5× larger, 6× larger or more than the diameter of the riser.

In an aspect, the distance between the riser wall and the diverter wall is less than 1 inch.

In a particular aspect, the distance between the riser wall and the diverter wall is less than 0.5 inch.

In other aspects, the distance between the riser wall and the diverter wall is between 0.5 inch and 12 feet. In other aspects, the distance between the riser wall and the diverter wall is between: 0.5 inch and 11 feet, or 0.5 inch and 10 feet, or 0.5 inch and 9 feet, or 0.5 inch and 8 feet, or 0.5 inch and 7 feet, or 0.5 inch and 6 feet, or 0.5 inch and 5 feet, or 0.5 inch and 4 feet, or 0.5 inch and 3 feet, or 0.5 inch and 2 feet, or 0.5 inch and 12 inches, or 0.5 inch and 11 inches, or 0.5 inch and 10 inches, or 0.5 inch and 9 inches, or 0.5 inch and 8 inches, or 0.5 inch and 7 inches, or 0.5 inch and 6 inches, or 0.5 inch and 5 inches, or 0.5 inch and 4 inches, or 0.5 inch and 3 inches, or 0.5 inch and 2 inches, or 0.5 inch and 1 inch, or approximately 0.5 inch, or any combination of the aforementioned.

In an embodiment, the diverter apparatus is made of metal. In a particular embodiment, the diverter apparatus is made of steel. In another embodiment, the diverter apparatus is made of aluminum. In another embodiment, the diverter apparatus is made of iron.

In some embodiments, the diverter apparatus is made of plastic. In a particular embodiment, the diverter apparatus is made of PVC.

In some aspects, the diverter apparatus is made of wood.

In some aspects, the diverter apparatus is made of a polymer composite material.

In some embodiments, the diverter apparatus is tubular and comprises a closed end that is exposed to the ambient air above the water body's surface and an open end that is submerged beneath the water body's surface. In the embodiment, the closed end and the walls of the tubular diverter that extend down into the water body encircle a drop pipe or riser such that the drop pipe extends upward and into the diverter apparatus. Water flows between the walls of the diverter and the walls of the drop pipe and enters the top of the drop pipe through a baffle.

In some embodiments, the diverter apparatus is tubular (i.e. cylindrical) and comprises two open ends (i.e. apertures). One open end is exposed to the ambient air and is located proximal to a water body's surface. The other open end is submerged beneath the water body's surface and is thus distal to the water body's surface. In this embodiment, the open end proximal to the water body's surface has a means for attachment that attaches the diverter to an existing baffle or riser. In a particular embodiment, the open end of the diverter proximal to the water body's surface contains cross support bars that attach to a baffle or riser. In some aspects, the cross support bars contain a groove on one side of said bar that allows an existing baffle or riser to attach and "snap" thereto. Water flows between the walls of the diverter and the walls of the riser/drop pipe and enters the top of the riser/drop pipe through a baffle.

In an aspect, the disclosure provides a method of controlling beaver infestation in a pond, comprising: utilizing a water diverter apparatus as described herein to control the water that flows from the pond into a riser, wherein said water flow does not attract beavers.

In an aspect, the disclosure provides a method of preventing debris from clogging a water level management system in a pond, comprising: utilizing a water diverter apparatus as described herein to control the pond water that flows into the water management system's riser.

BRIEF DESCRIPTION OF THE DRAWINGS

FIGS. 10 A-C illustrates devices used to combat debris from clogging risers and pond water drainage pipes. As can be seen, all three of these embodiments rely upon a type of grating that is supposed to prevent debris from entering the drainage pipes. All three embodiments suffer from the fact that water enters the risers from a pond's surface and thus there is created a running/falling water scenario that attracts beavers to the site. Further, even if the debris gratings are successful in keeping debris out of the actual riser or drainage pipes themselves, the debris simply builds up against the debris grating and eventually creates an impenetrable layer of debris that prevents water from entering the riser or drainage pipe. This scenario leads to flooding, as the pond water level is no longer being managed.

DETAILED DESCRIPTION

Figure 1:
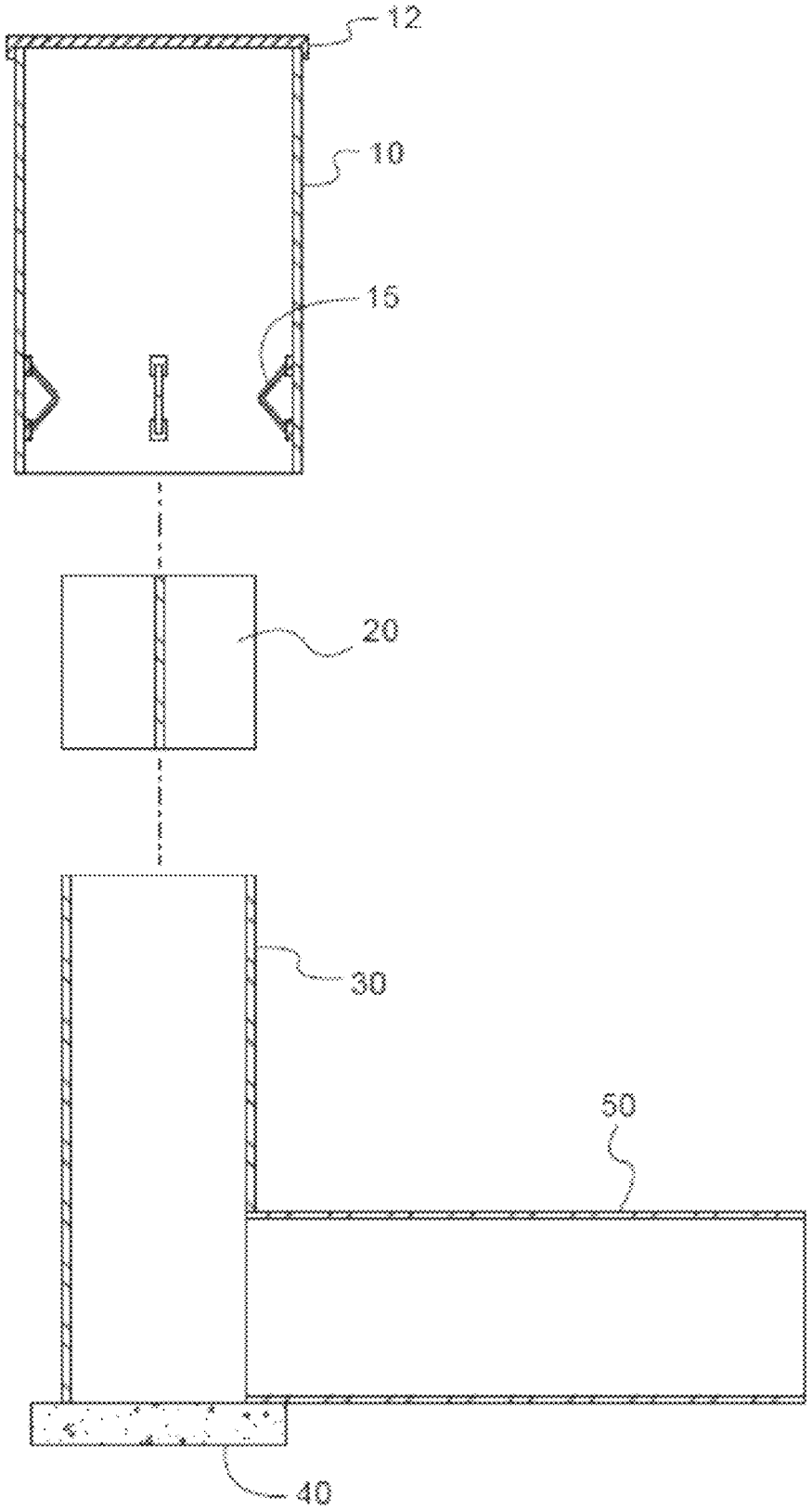
FIG. 1 is an exploded view cross section of an embodiment of a water diverter apparatus as disclosed herein. The embodiment comprises: a water diverter 10, stabilizers 15, cross support bars 12, vortex baffle 20, riser 30, base 40, and outlet barrel 50. The outlet barrel 50 is sometimes referred to as a "discharge pipe," as the terms are used synonymously.

Detailed descriptions of one or more preferred embodiments are provided herein. It is to be understood, however, that the present disclosure may be embodied in various forms. Therefore, specific details disclosed herein are not to be interpreted as limiting, but rather as a basis for the claims and as a representative basis for teaching one skilled in the art to employ the present disclosure in any appropriate manner.

"About" means plus or minus a percent (e.g., ±10%) of the number, parameter, or characteristic so qualified, which would be understood as appropriate by a skilled artisan to the scientific context in which the term is utilized. Also, "about" can mean plus or minus a quantifiable length of a parameter (e.g., ±6-12 inches). Furthermore, since all numbers, values, and expressions referring to quantities used herein, are subject to the various uncertainties of measurement encountered in the art, then unless otherwise indicated, all presented values may be understood as modified by the term "about."

As used herein, the articles "a," "an," and "the" may include plural referents unless otherwise expressly limited to one-referent, or if it would be obvious to a skilled artisan from the context of the sentence that the article referred to a singular referent.

Where a numerical range is disclosed herein, then such a range is continuous, inclusive of both the minimum and maximum values of the range, as well as every value between such minimum and maximum values. Still further, where a range refers to integers, every integer between the minimum and maximum values of such range is included. In addition, where multiple ranges are provided to describe a feature or characteristic, such ranges can be combined. That is to say that, unless otherwise indicated, all ranges disclosed herein are to be understood to encompass any and all subranges subsumed therein. For example, a stated range of from "1 to 10" should be considered to include any and all subranges between the minimum value of 1 and the maximum value of 10. Exemplary subranges of the range "1 to 10" include, but are not limited to, 1 to 6.1, 3.5 to 7.8, and 5.5 to 10.

Throughout the United States, there is a huge number of drop-inlet type structures (both metal and plastic) being used for various purposes. These structures are also termed drop pipe structures or drop riser structures.

Some uses of these drop-inlet structures are to control the water level in recreational ponds and lakes, control soil erosion, flood wildlife impoundments, and provide water for irrigation reservoirs, etc.

A problem with the typical drop-inlet type structure is that floating debris follows the moving water current and partially blocks the top of the riser, which invites beavers to complete the job of filling the riser with debris and mud. The beavers are attracted to the top of the riser by visually observing both the surface debris and the water surface current, as well as hearing the trickling or falling water sound, as the surface water spills into the riser.

The present disclosure alleviates the problems encountered in the art, by providing a water diverter apparatus that can be installed on top of an existing riser, which effectively prevents debris from clogging the riser and does not attract beavers to the area.

The water diverter apparatus directs water from near the bottom of the riser, up between the riser and the water diverter, and then over the top of the riser and down through the riser. The beavers cannot see the water flowing into the riser. Since debris floats and cannot enter the riser, because the riser is blocked by the water diverter, beavers are not able to perform dam building activities near the riser.

The water diverter apparatus is extremely low maintenance once installed, as compared to the drop-inlet structures of the prior art, which are continually clogged by beavers and require maintenance to remove debris and repair beaver damage.

The water diverter apparatus also draws stagnant oxygen depleted water from the bottom of an impoundment and allows the fresh oxygen-filled water to remain on top of the water body.

Reference will now be made to the drawings of various embodiments of the disclosed apparatus, wherein like reference numerals refer to like parts throughout.

An embodiment of the water diverter apparatus will now be described with reference to FIG. 1.

In this embodiment, the water diverter apparatus comprises: a water diverter 10, stabilizers 15, cross support bars 12, vortex baffle 20, riser 30, base 40, and outlet barrel 50.

In this embodiment, the water diverter 10 is tubular and comprises two ends.

One end of the water diverter 10 is proximal to a water body's (e.g. a pond) surface. This is the end of the water diverter 10 that comprises cross support bars 12. The cross support bars are a means for attaching the water diverter 10 to a baffle, if a baffle is present, or a riser, if said baffle is not present. Thus, the cross support bars 12 may serve as a means for attaching the water diverter to a baffle, or to a riser. The cross support bars 12 may be in an "X" or "cross" shape. However, the cross support bars may also be in any other shape and can be embodied as a solid plate, or cap, or grate, at the end of the water diverter 10 proximal to the water body's surface.

One end of the water diverter 10 is distal to the water body's surface. This end of the water diverter 10 can also be said to be proximal to the bottom of a water body, e.g. proximal to the earthen soil or mud of a pond's bottom.

The water diverter 10 can be tubular as represented in FIG. 1. However, the water diverter can be any shape. The water diverter 10 can be square, rectangular, triangular, or amorphous.

The water diverter 10 must function to divert water from the surface of a water body (e.g. pond surface) and cause the water to enter the water diverter 10 from below the water body's surface.

In some aspects, the water enters the water diverter close to a pond's bottom. In some aspects, the water enters the water diverter in the middle of a pond's water column.

In some aspects, the water enters the water diverter a few inches below a water body's surface, or in some aspects a few feet below a water body's surface.

The vortex baffle 20 of FIG. 1 sits atop the riser 30. As previously mentioned, a riser is also termed a drop pipe, or drop pipe riser. The vortex baffle may comprise two planes that intersect at a midsection, and thus form a cross shape, as illustrated in FIG. 1. However, the vortex baffle may be in any shape, so long as the baffle creates a vortex of water flow at the water body's surface. The precise shape of the baffle is not important, as the water diverter 10 sits atop the baffle 20 and prevents surface water from entering the riser 30 from the surface. Thus, prior art attempts to create baffles that mitigate riser debris cloggage are unimportant, as the present disclosure presents a better solution to riser debris cloggage than the baffles of the prior art, by causing surface water to go around the diverter apparatus at the water body's surface and enter the water diverter from below the water body's surface.

The riser 30, or drop pipe, functions as a conduit to move water out of the water body (e.g. pond) and through an outlet barrel 50, or discharge pipe, into an area where the water is desired to go, which sometimes may be the other side of a dam.

The stabilizers 15 function as a means for keeping the water diverter 10 in proper placement with respect to the riser 30. In some aspects, the stabilizers are metal and have points of attachment (e.g. two points of attachment) to the interior of the tubular water diverter 10 wall. The stabilizers also come into physical contact with the exterior of the riser 30 wall, but are not attached or fastened to the exterior riser 30 wall. The stabilizers help to keep the water diverter 10 from shifting during excessive winds or high water current.

The base 40 functions to support the weight of the structure and in some embodiments is a concrete slab.

An embodiment of the water diverter apparatus will now be described with reference to FIG. 2.

The elements of the water diverter apparatus are as described with respect to FIG. 1. Additionally, FIG. 2 illustrates the diverter apparatus in an assembled state and in relation to a water body's surface 60.

The figure depicts the flow of water from below the surface of the water body up through the water diverter 10, and into the riser 30 by flowing around the vortex baffle 20 located at the top of the riser 30, and out through an outlet barrel 50.

Thus, the water flows from below the water body's surface up into the apparatus by flowing in between the interior wall of the water diverter 10 and the exterior wall of the riser 30, until ultimately flowing over the top of the riser 30, down through the riser 30, and out through the outlet barrel 50, as depicted by the arrows in FIG. 2.

As can be seen from the arrows of water movement through the apparatus, there is no surface current created that would attract beavers. Further, there is no surface running water or trickling water that a beaver could access or visually see from the water body's surface.

The figure illustrates how the stabilizers 15 function as a means for keeping the water diverter 10 in proper placement with respect to the riser 30. The entire water diverter 10 is resting on top of the vortex baffle 20, by means of cross support bars 12. The riser 30 is supported by the base 40.

The vortex baffle 20, riser 30, base 40, and outlet barrel 50, may be preexisting structures on a landowner's property. In this situation, the landowner may wish to convert his existing structure into a more effective pond water level management system, by installing the water diverter 10, as described.

Thus, the present disclosure envisions altering the specific shape and components of the water diverter 10 to be custom designed to fit a landowner's preexisting water level management apparatus. The water diverter 10 must always maintain its function of diverting water from entering a riser from the water body's surface and instead causing the water to enter a riser from below the water body's surface.

If there are no preexisting structures in a water body, then a landowner could install all components.

An embodiment of the water diverter apparatus will now be described with reference to FIG. 3.

Figure 2:
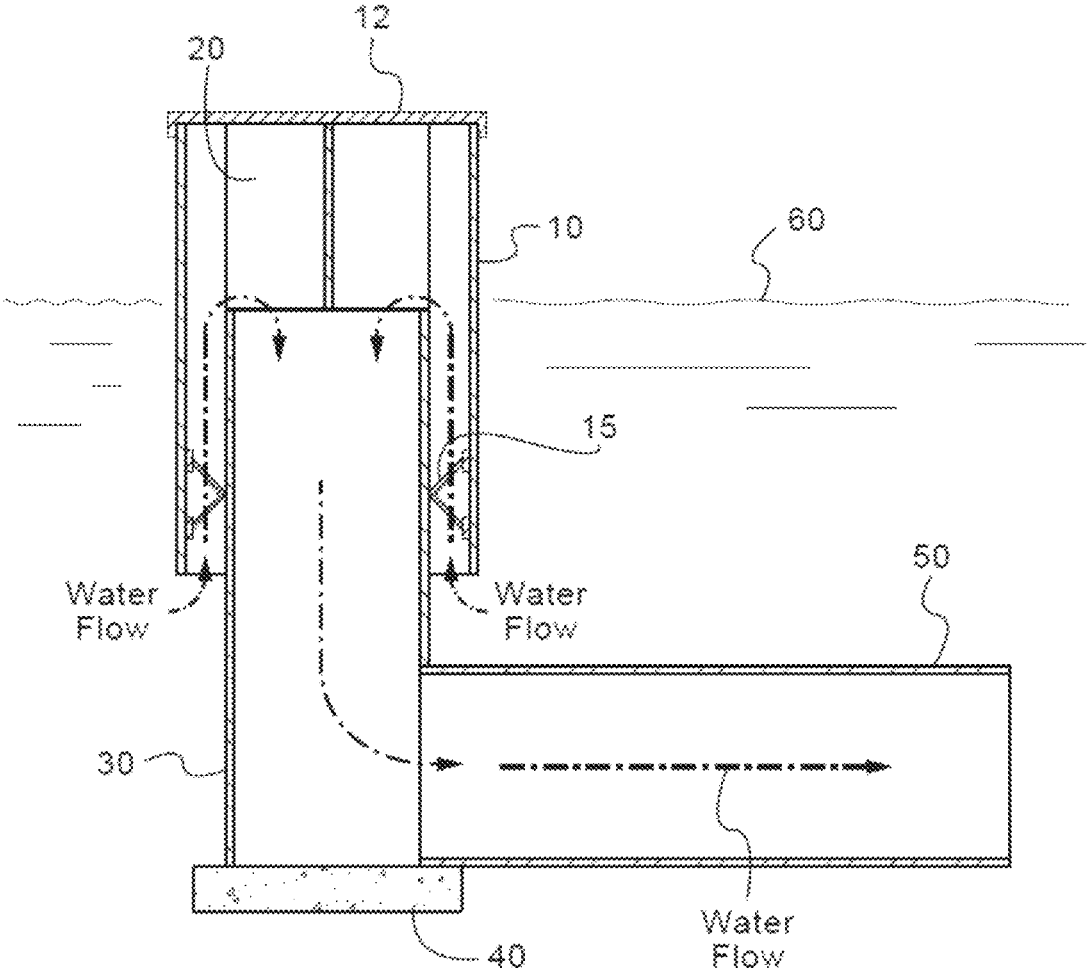
FIG. 2 is an assembled view cross section of an embodiment of a water diver apparatus as disclosed herein, in relation to a water body's surface. The figure depicts the flow of water from below the surface of the water body up through the water diverter 10, and into the riser 30 by flowing around the vortex baffle 20 located at the top of the riser 30, and out through an outlet barrel 50. The figure illustrates how the stabilizers 15 function as a means for keeping the water diverter 10 in proper placement with respect to the riser 30. The entire water diverter 10 is resting on top of the vortex baffle 20, by means of cross support bars 12. The riser 30 is supported by the base 40. The figure illustrates how water from a water body's surface 60 does not flow into the water diverter apparatus from the water body's surface, but rather flows up into the water diverter 10 from below the water body's surface. At the water body's surface 60, the water flows around the water diverter 10 and does not create beaver attracting running/falling water and helps to prevent the riser 30 from becoming clogged by debris that easily builds up against vortex baffles 20, which do not contain a water diverter 10 as depicted.

The elements of the water diverter apparatus are as described with respect to FIG. 1 and FIG. 2.

Figure 3:
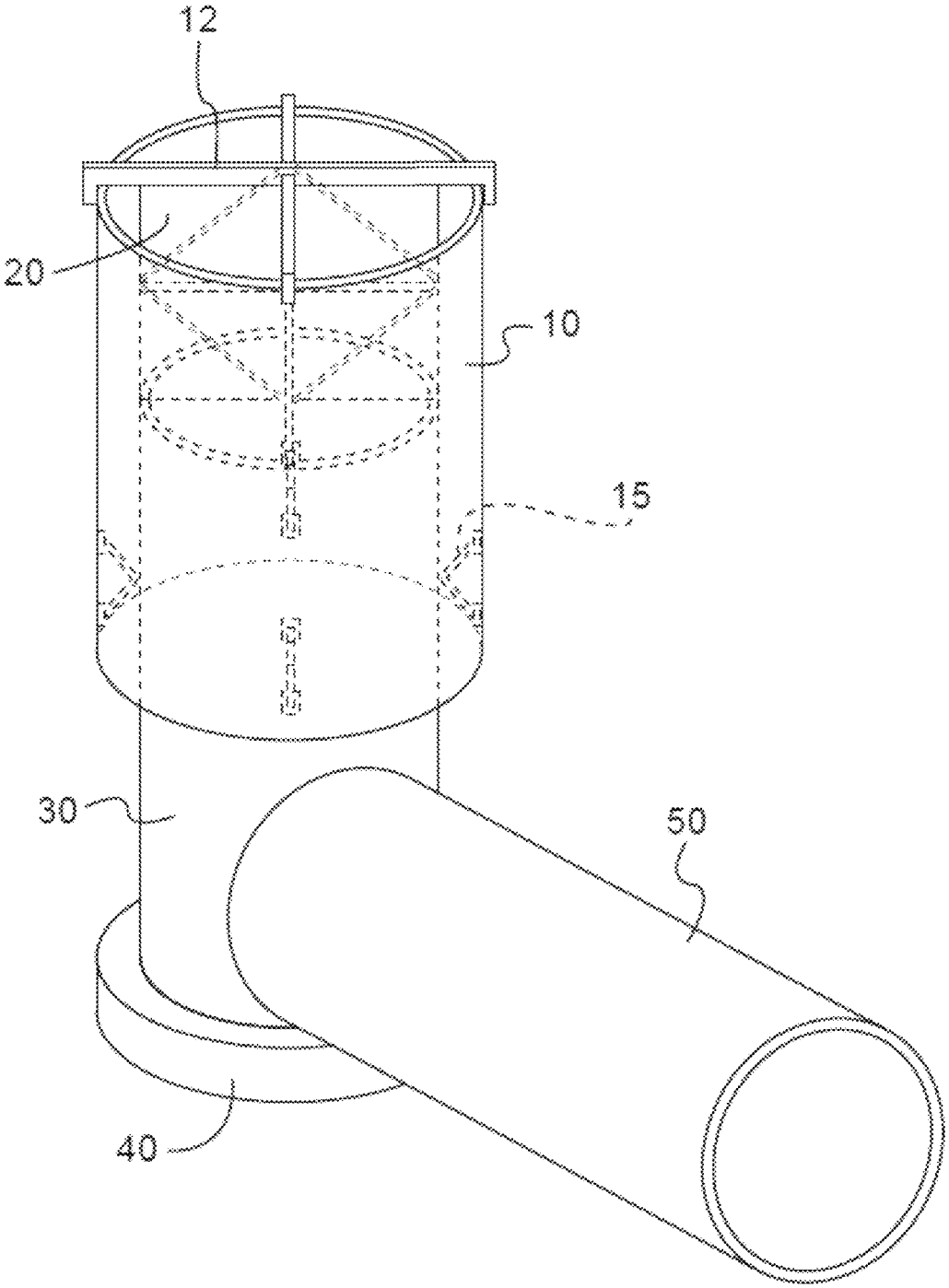
FIG. 3 is an assembled perspective view of an embodiment of a water diverter apparatus as disclosed herein, comprising: a water diverter 10, cross support bars 12, a vortex baffle 20, stabilizers 15, a riser 30, a base 40, and outlet barrel 50.

Additionally, FIG. 3 illustrates how an end of the water diverter 10, proximal to a water body's surface, may comprise cross support bars 12, which attach to a vortex baffle 20.

As aforementioned, the cross support bars are a means for attaching the water diverter 10 to a baffle, if a baffle is present, or a riser, if said baffle is not present. Thus, the cross support bars 12 may serve as a means for attaching the water diverter to a baffle, or to a riser.

The cross support bars 12 may be in an "X" or "cross" shape as illustrated in FIG. 3. However, the cross support bars may also be in any other shape and can be embodied as a solid plate, or cap, or grate, at the end of the water diverter 10 proximal to the water body's surface. By "attachment" it is meant either permanent or removable attachment. Tlms, the cross support bars 12 may, for example, be welded to the baffle as a representation of a permanent means of attachment. Alternatively, the cross support bars 12 may have, for example, a groove or indentation on the side of said cross bars that will be in contact with the vortex baffle 20, such that the vortex baffle 20 "snaps" into the cross support bars 12, thus representing a removable attachment mechanism, which would allow for the water diverter 10 to be lifted off the vortex baffle 20 if so desired, for example to do maintenance on the riser 30.

Figure 4:
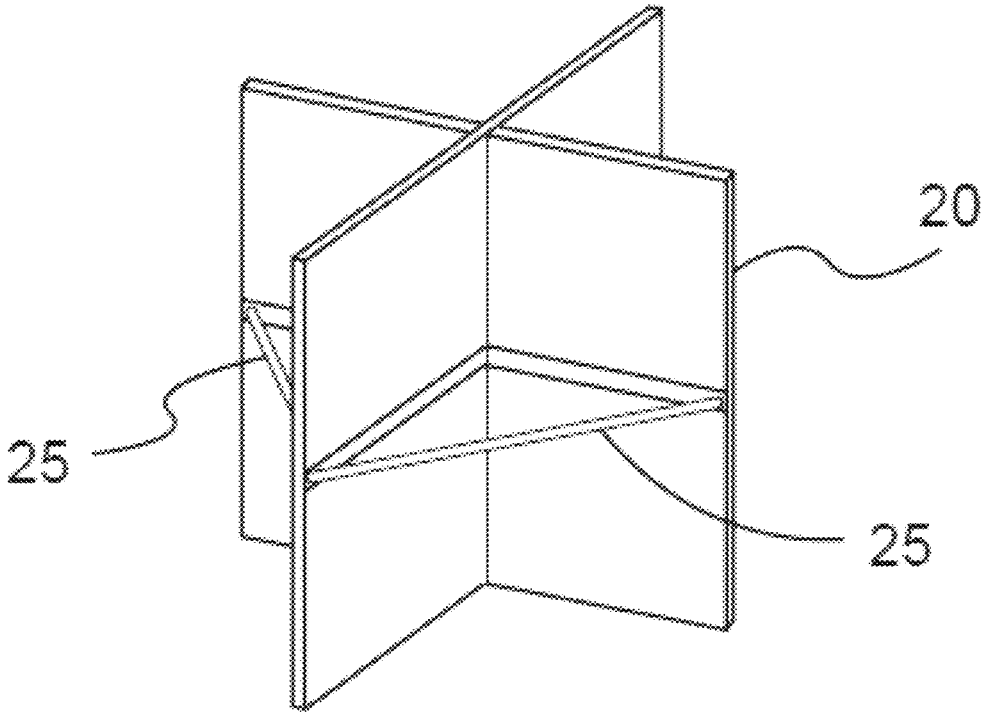
FIG. 4 is a perspective view of a vortex baffle 20, with support brackets 25.

An embodiment of the water diverter apparatus will now be described with reference to FIG. 4, which illustrates a vortex baffle 20. The vortex baffle may comprise support brackets 25, which function to help the intersecting planes of the vortex baffle 20 to maintain their integrity.

Figure 5:
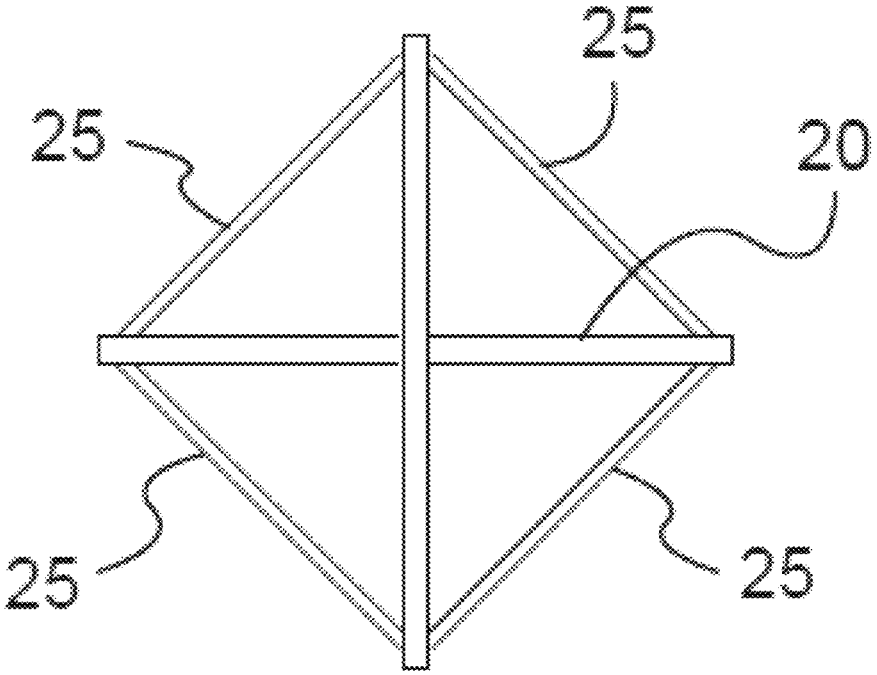
FIG. 5 is a top down (or bottom up) view of a vortex baffle 20, with support brackets 25.

An embodiment of the water diverter apparatus will now be described with reference to FIG. 5, which illustrates a top down view of a vortex baffle 20, with support brackets 25.

Figure 6:
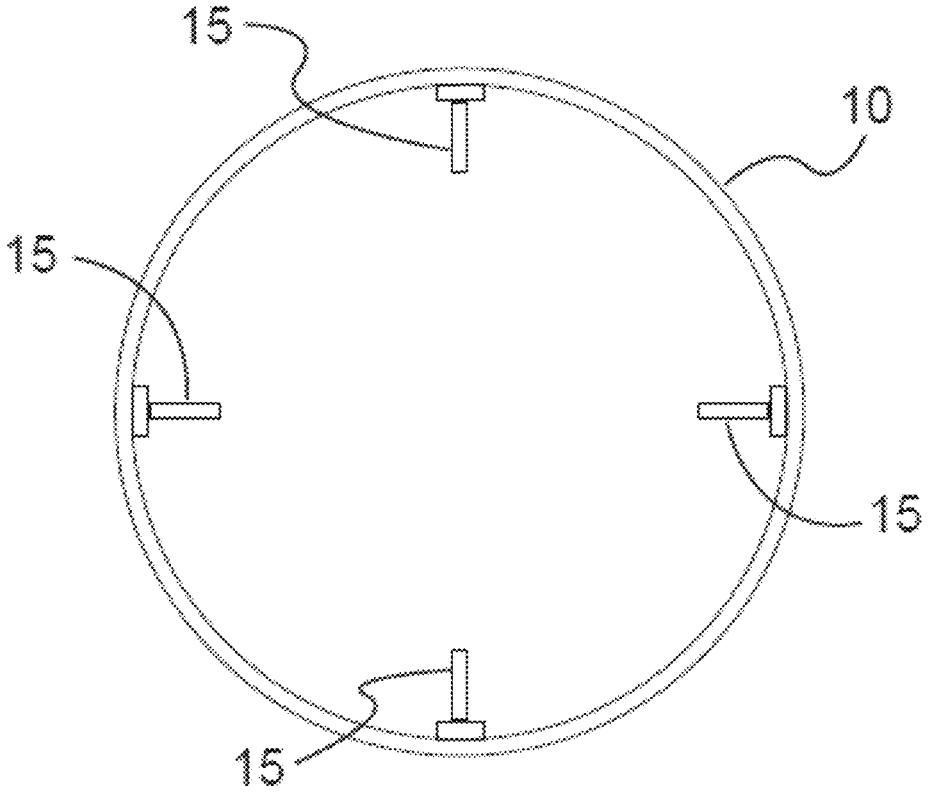
FIG. 6 is a top down (or bottom up) view of an embodiment of a water diverter 10 with stabilizers 15.

An embodiment of the water diverter apparatus will now be described with reference to FIG. 6, which illustrates a top down (or bottom up) view of an embodiment of a water diverter 10 with stabilizers 15. The water diverter 10 is depicted as being tubular. The term "tubular" is also referred to by artisans as "cylindrical." Consequently, the embodiments of the water diverter 10 discussed as being "tubular" could also be referred to as "cylindrical" water diverters.

Figure 7:
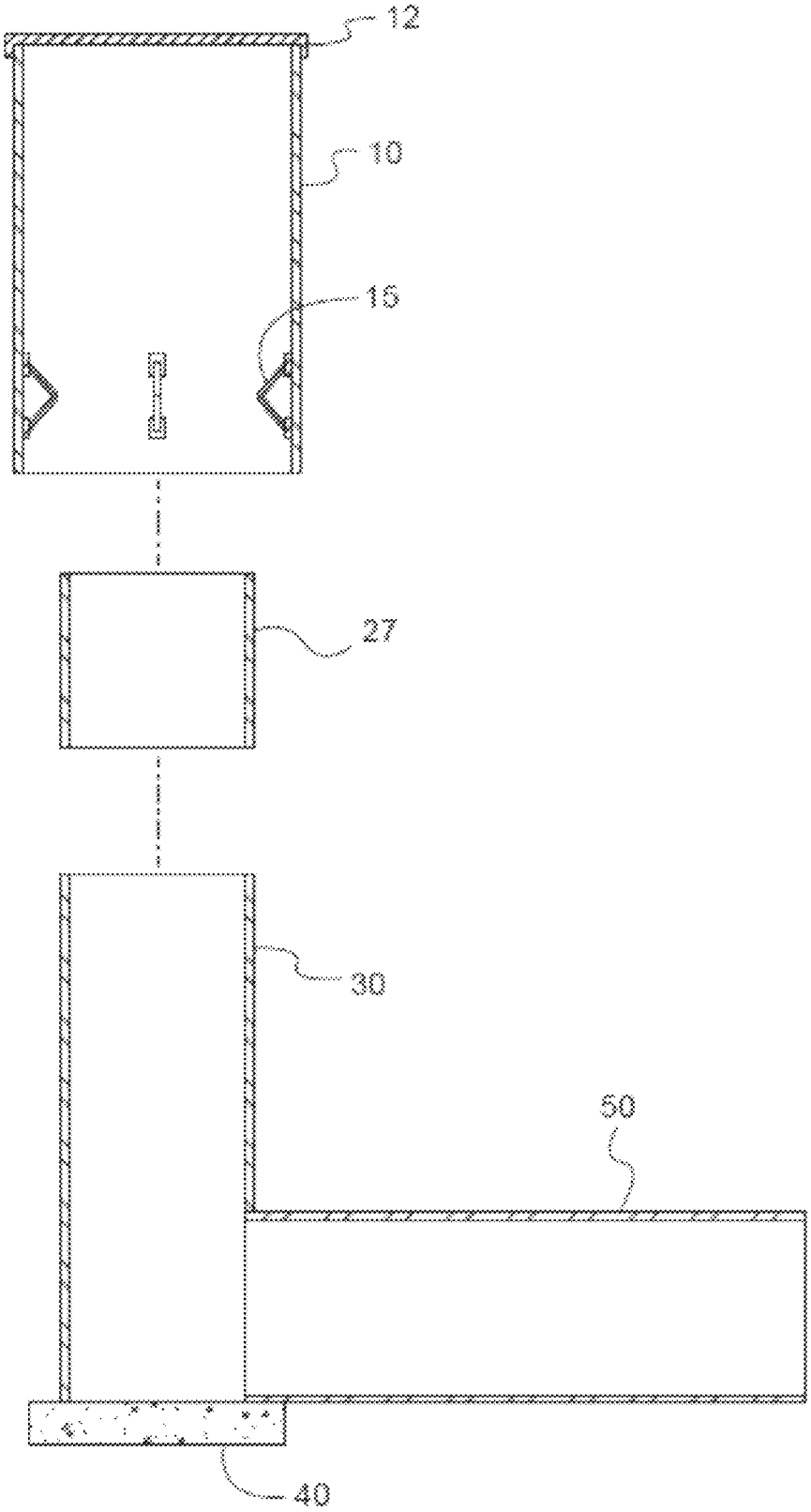
FIG. 7 is an exploded view cross section of an embodiment of a water diverter apparatus as disclosed herein. The embodiment comprises: a water diverter 10, stabilizers 15, cross support bars 12, generic baffle 27 (i.e. any type of baffle and not limited to vortex baffles), riser 30, base 40, and outlet barrel 50.

An embodiment of the water diverter apparatus will now be described with reference to FIG. 7.

The elements of the water diverter apparatus are as described with respect to FIGS. 1-6. Additionally, FIG. 7 illustrates the diverter apparatus comprising a generic baffle 27, as opposed to the previously discussed vortex baffle 20.

As utilized herein, the term "generic baffle" refers to any type of baffle that is placed upon a riser 30, which is not a vortex baffle 20. Thus, in some embodiments, the generic baffle 27 will be the same tubular shape as that of a riser 30. The generic baffle may, in some embodiments, comprise a tubular mesh grating.

Figure 8:
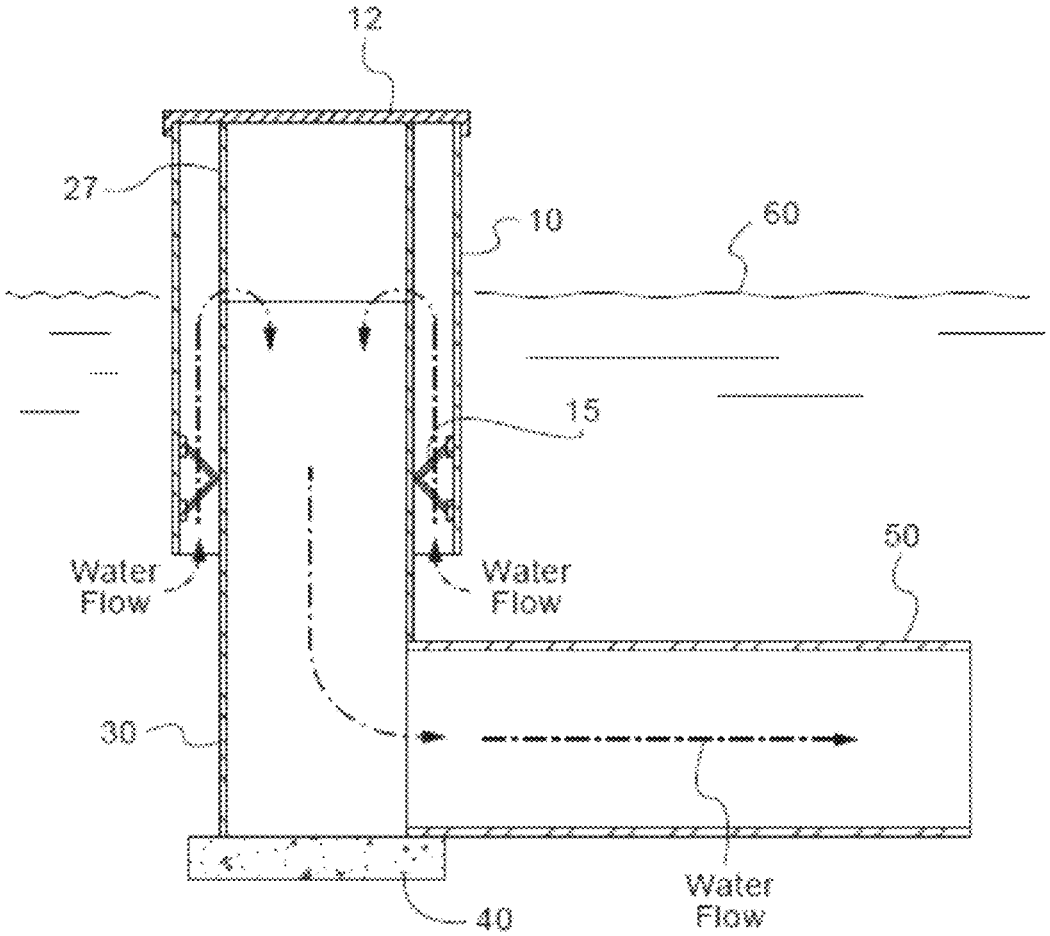
FIG. 8 is an assembled view cross section of an embodiment of a water diver apparatus as disclosed herein, in relation to a water body's surface. The figure depicts the flow of water from below the surface of the water body up through the water diverter 10, and into the riser 30 by flowing around the generic baffle 27 located at the top of the riser 30, and out through an outlet barrel 50. The figure illustrates how the stabilizers 15 function as a means for keeping the water diverter 10 in proper placement with respect to the riser 30. The entire water diverter 10 is resting on top of the generic baffle 27, by means of cross support bars 12. The riser 30 is supported by the base 40. The figure illustrates how water from the water body's surface 60 does not flow into the water diverter apparatus from the water body's surface, but rather flows up into the water diverter 10 from below the water body's surface. At the water body's surface 60, the water flows around the water diverter 10 and does not create beaver attracting running/falling water and helps to prevent the riser 30 from becoming clogged by debris that easily builds up against generic baffles 27, which do not contain a water diverter 10 as depicted.

An embodiment of the water diverter apparatus will now be described with reference to FIG. 8.

The elements of the water diverter apparatus are as described with respect to FIGS. 1-7. Additionally, FIG. 8 illustrates the diverter apparatus comprising a generic baffle 27, in an assembled state and in relation to a water body's surface 60. The flow of water is depicted by the arrows in the figure and has been previously discussed with reference to FIG. 2.

An embodiment of the water diverter apparatus will now be described with reference to FIG. 9.

The elements of the water diverter apparatus are as described with respect to FIGS. 1-8.

Figure 9:
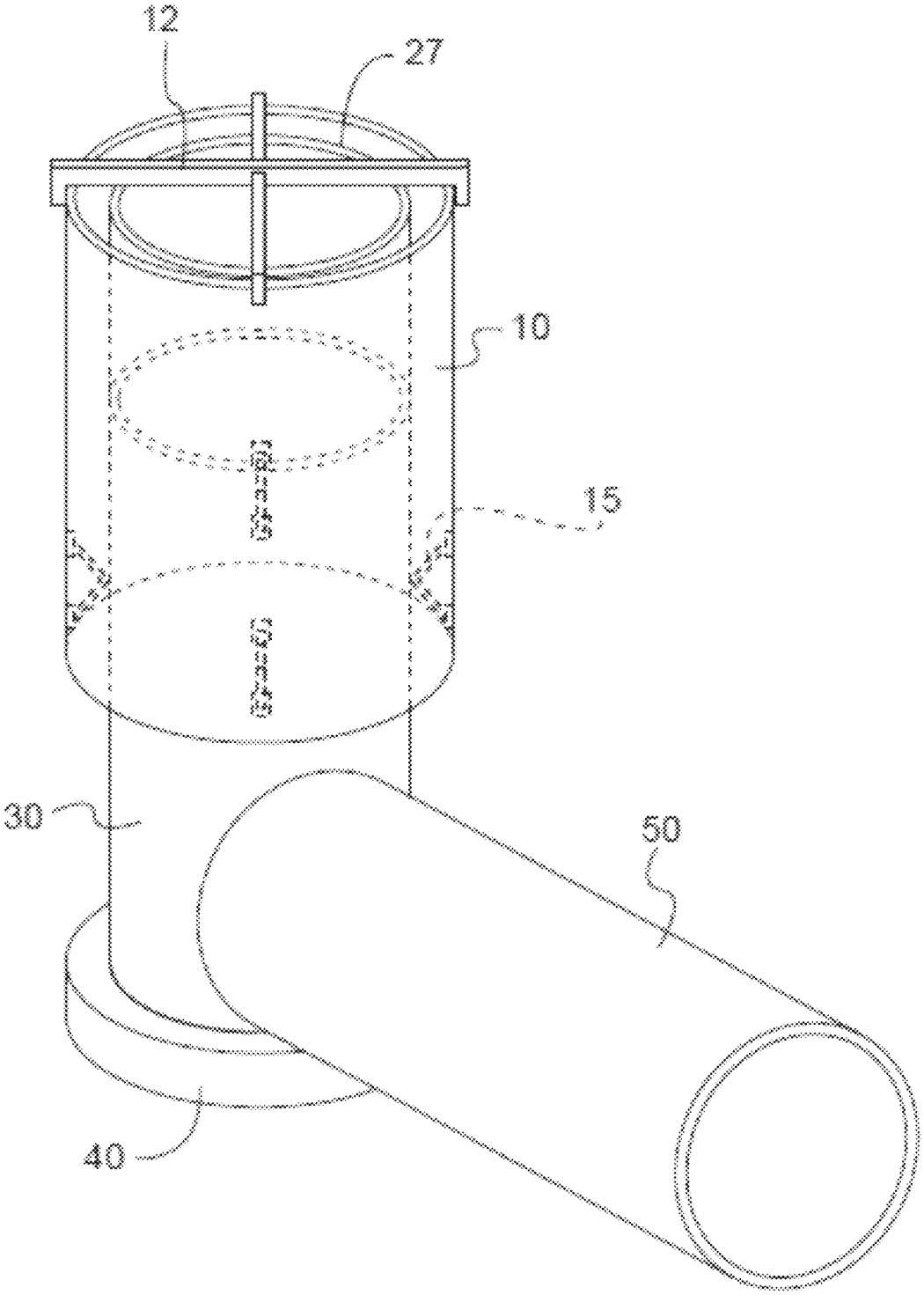
FIG. 9 is an assembled perspective view of an embodiment of a water diverter apparatus as disclosed herein, comprising: a water diverter 10, cross support bars 12, a generic baffle 27, stabilizers 15, a riser 30, a base 40, and outlet barrel 50.
Figure 11:
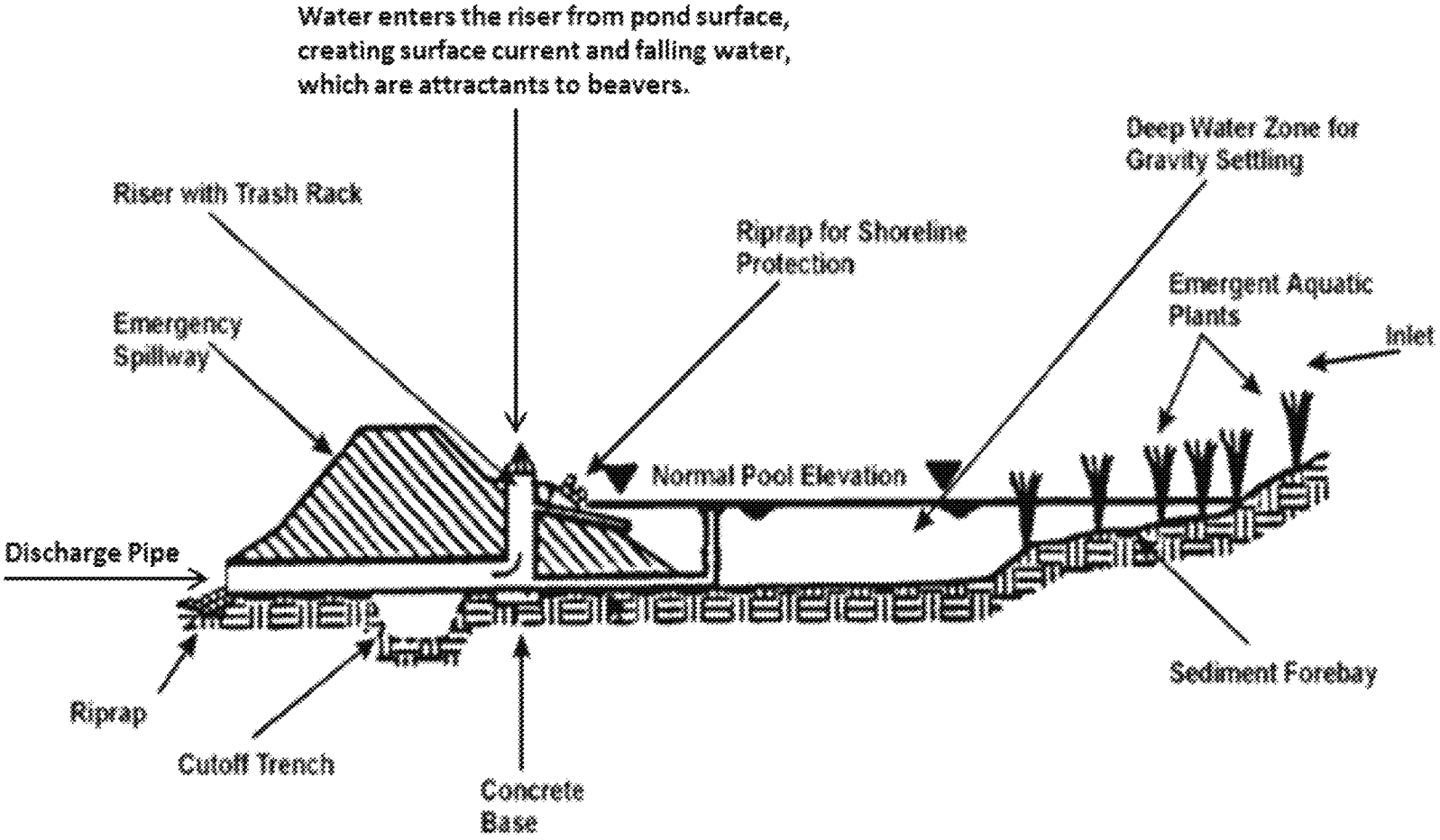
FIG. 11 illustrates a generalized schematic of a pond water level management system that uses a water drainage structure, comprising: a riser, concrete anchoring base, and discharge pipe.
Figure 12A:
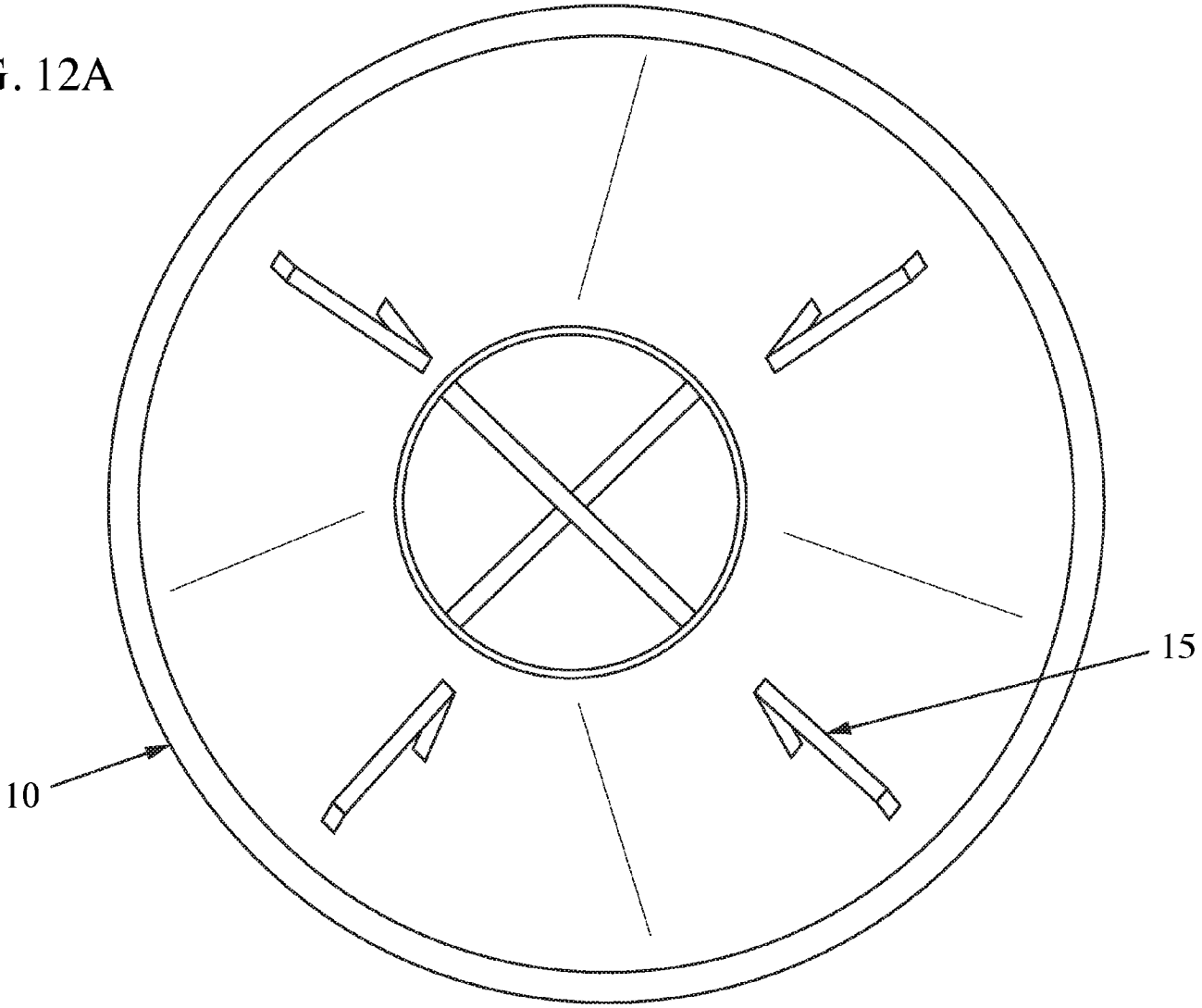
FIG. 12A shows a view looking into a water diverter 10 from the perspective of the end of the water diverter 10 that lies distal to the water's surface. This end of the water diverter 10 (i.e. end closest to a pond bottom) does not contain cross support bars 12, which are located at the end of the water diverter 10 proximal to the water's surface. In embodiments, the end of the water diverter 10 that lies proximal to the water's surface contains support bars 12, which attach to a baffle and are a means for attachment of said diverter 10, e.g. a vortex baffle 20 or any type of generic baffle 27, or attach to a riser 30 if no baffle is present.
Figure 12B:
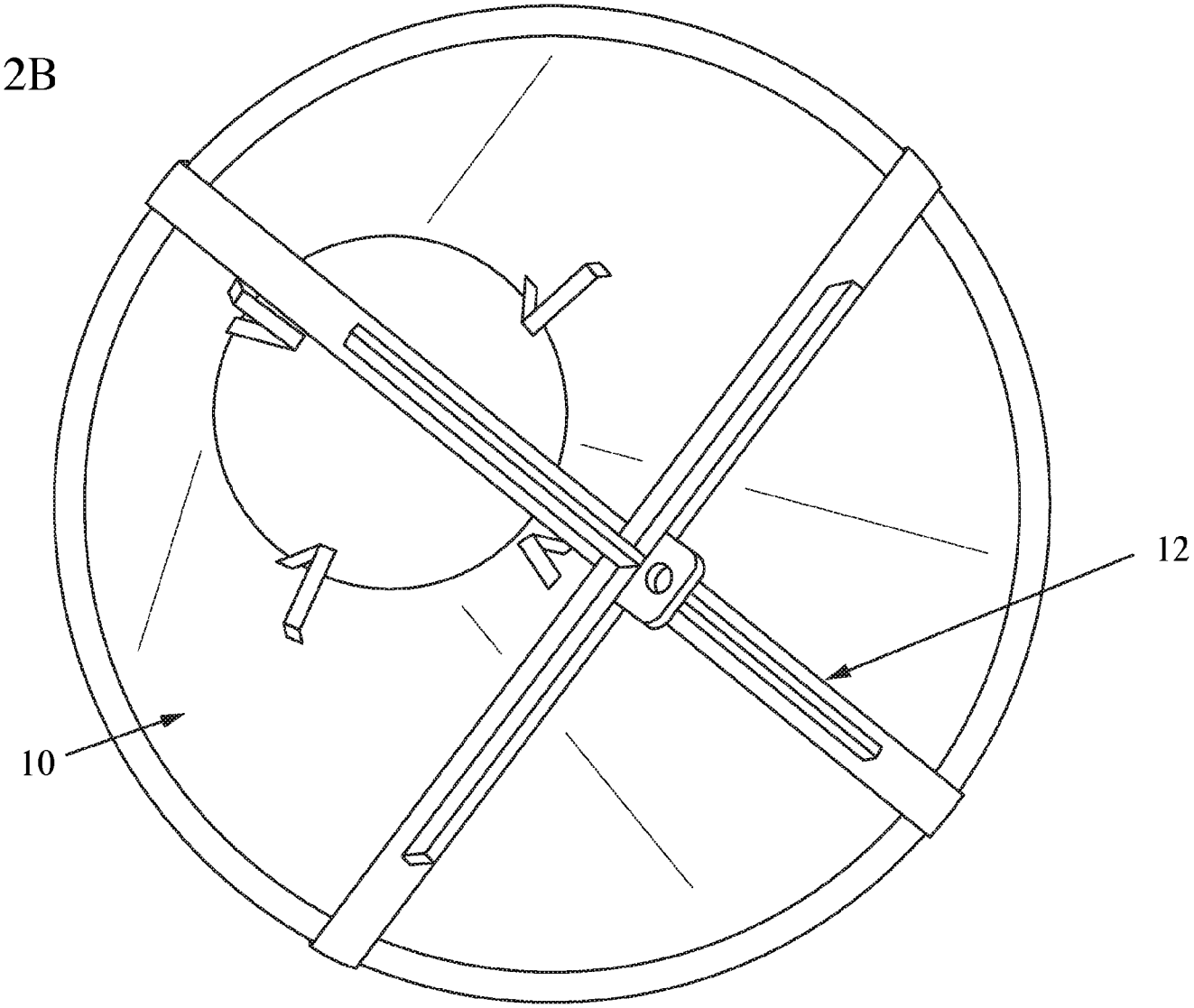
FIG. 12B shows a view looking into a water diverter 10 from the perspective of the end of the water diverter 10 that lies proximal to the water's surface. This end of the water diverter 10 (i.e. end closest to a pond water surface) contains cross support bars 12, which attach to a baffle, e.g. a vortex baffle 20 or any type of generic baffle 27, or attach to a riser 30 if no baffle is present.
Figure 13:
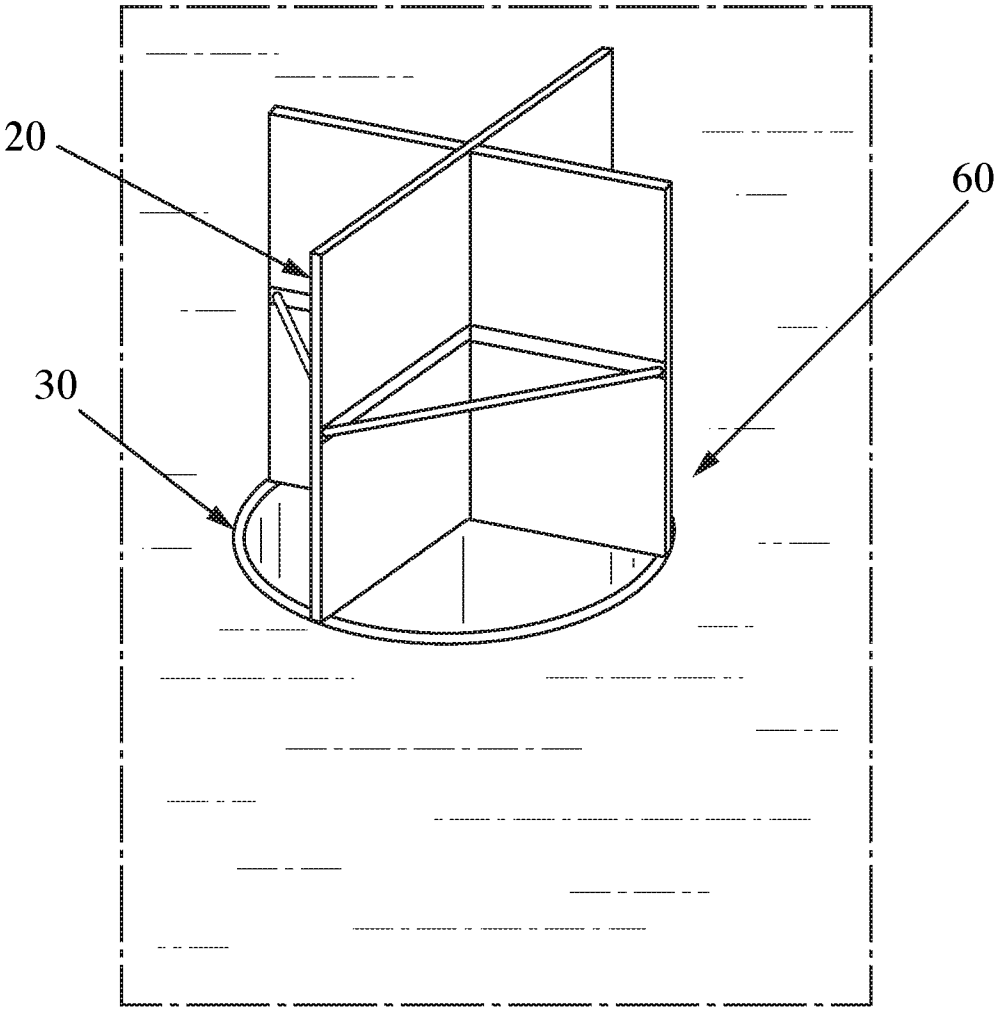
FIG. 13 illustrates a vortex baffle 20, which is sitting atop a riser 30, with surface water 60.
Figure 14:
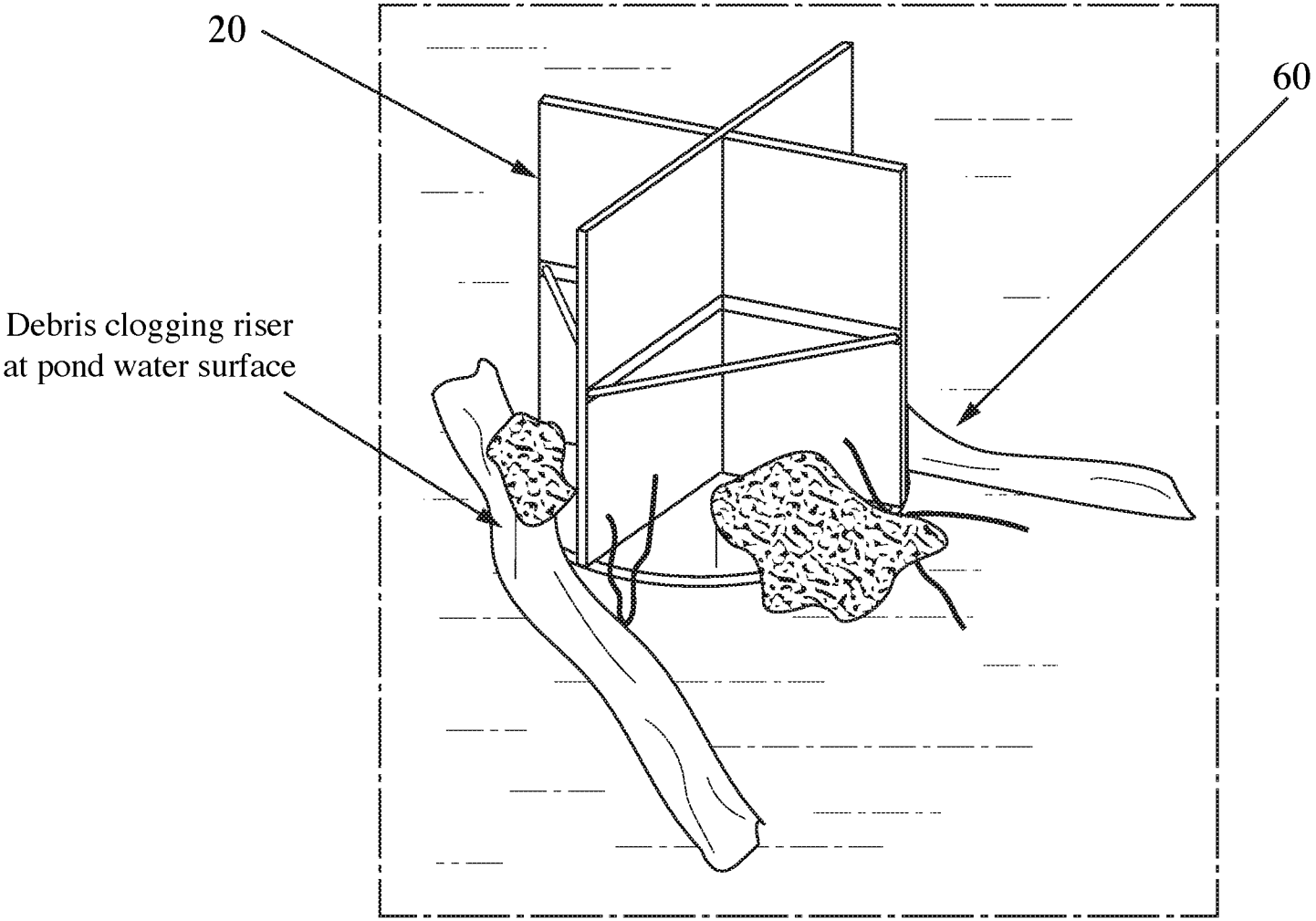
FIG. 14 illustrates a vortex baffle 20 with debris beginning to clog the riser 30 at the pond water's surface 60.

Additionally, FIG. 9 illustrates how an end of the water diverter 10, proximal to a water body's surface, may comprise cross support bars 12, which attach to a generic baffle 27. As aforementioned, the cross support bars are a means for attaching the water diverter 10 to a baffle, if a baffle is present, or a riser, if said baffle is not present. Thus, the cross support bars 12 may serve as a means for attaching the water diverter to a baffle, or to a riser. The cross support bars 12 may be in any shape and can be embodied as a solid plate, or cap, or grate, at the end of the water diverter 10 proximal to the water body's surface. In FIG. 9, the cross support bars 12 are in the shape of an "X" or cross and provide a means for attaching the generic baffle 27 to the water diverter 10.

EXAMPLES

Example 1

General Experimental Observations Upon Installing an Experimental Water Diverter Apparatus According to the Disclosure A water diverter apparatus has been installed in ponds in Mississippi to experimentally test the effect on debris buildup and beaver attraction. The installed water diverter apparatus was as depicted in FIGS. 1-9.

The water diverter apparatus was installed in ponds that had severe beaver infestation that resulted in constant clogging of the existing water control apparatus via the beavers building dams and clogging the riser.

The experimental water diverter apparatus was installed on existing riser assemblies and subsequently monitored.

The water diverter apparatus led to continual water flow into the riser that was not impeded by debris buildup and was not clogged by beaver dams.

The inventor observed that beavers were not attracted to the water level management apparatus with the water diverter installed, as there was no surface water current or whirlpools to attract the beavers.

Consequently, once the experimental water diverter apparatus was installed in these ponds the landowner was able to effectively control the level of water in the pond.

Example 2

Specific Experimental Observations Upon Installing an Experimental Water Diverter Apparatus According to the Disclosure A water diverter apparatus as depicted in FIGS. 1-9 was installed in Carroll County, Mississippi to experimentally test the effect on debris buildup and beaver attraction.

The landowner had a preexisting metal drop inlet (riser) type water control structure in a pond to provide water level maintenance. However, the metal drop inlet riser was continually clogged by beavers building damns upon the top of the riser, which prevented water from flowing into the riser.

Consequently, the water from the pond was frequently forced through the emergency spillway existing on the pond, which in turn led to severe erosion and loss of pond water. Furthermore, the beavers were damaging the riser and the structure had to be replaced.

Upon installation of an experimental water diverter apparatus as taught herein, the beavers stopped building dams near the riser.

The experimental water diverter apparatus has now been present at the landowner's property and there is still no sign of beaver activity near the riser, despite obvious indications (e.g. new beaver lodges and cuttings) that beavers still inhabit the pond.

Example 3

Specific Experimental Observations Upon Installing an Experimental Water Diverter Apparatus According to the Disclosure A water diverter apparatus as depicted in FIGS. 1-9 was installed in Carroll County, Mississippi to experimentally test the effect on debris buildup and beaver attraction.

The landowner had a preexisting metal drop inlet (riser) type water control structure in a lake to provide water level maintenance. However, the metal drop inlet riser was continually clogged by beavers lodging sticks, logs, and debris in the water discharge riser.

Upon installation of an experimental water diverter apparatus as taught herein, the beavers stopped clogging the riser.

The experimental water diverter apparatus has now been present at the landowner's property and is still providing effective beaver control, as the beavers are not clogging the riser with debris. Thus, the water diverter apparatus as taught herein is effective in lakes, at preventing beavers from clogging water discharge risers.

INCORPORATION BY REFERENCE

All references, articles, publications, patents, patent publications, and patent applications cited herein, are hereby incorporated by reference in their entireties for all purposes.

REFERENCES CITED

Cronk & Fennessy, *Wetland Plants Biology and Ecology*, Lewis Publishers, 2001.

Begon, er al., *Ecology: Individuals, Populations, and Communities*, Blackwell Scientific Publications, 2$^{nd}$ Edition, 1990.

U.S. patent application Ser. No. 10/310,632, filed on Dec. 5, 2002, published as US Pub. No. 2003/0121850 A1, on Jul. 3, 2003.

U.S. Pat. No. 4,494,345, filed on Aug. 12, 1982, issued on Jan. 22, 1985.

U.S. Pat. No. 5,405,217, filed on Nov. 12, 1991, and issued on Apr. 11, 1995.

U.S. Pat. No. 7,232,278 filed on Aug. 7, 2006, and issued on Jun. 19, 2007.

U.S. Pat. No. 7,762,741, filed on May 11, 2009, and issued on Jul. 27, 2010.

U.S. Pat. No. 8,672,585, filed on Feb. 1, 2012, issued on Mar. 18, 2014.

International PCT Application No. PCT/DK2012/000134, filed on Dec. 21, 2012, published as WO 2013/107449 A1.

International PCT Application No. PCT/US2010/033850, filed on May 6, 2010, published as WO 2010/132267 A2.

What is claimed is:

1. A water level management apparatus, comprising:

a. a cylindrical water diverter comprising two apertures;

i. one of said apertures adapted to be located below a surface of a water body, ii. one of said apertures adapted to be located above a surface of a water body, wherein said cylindrical water diverter is adapted to divert water from a water body's surface and cause said water to enter the water level management apparatus from below the surface of said water body through the cylindrical water diverter's aperture located below the water body's surface;

b. a baffle;

wherein the cylindrical water diverter is attached to said baffle by an attachment means, said attachment means adapted to span the diameter of the cylindrical water diverter's aperture located above the water body's surface; and c. a riser;

wherein said riser is attached to the baffle distally to the baffle's point of attachment to the cylindrical water diverter's aperture located above the water body's surface, such that said baffle is positioned on the top of the riser and the cylindrical water diverter is positioned on top of said baffle.

2. The water level management apparatus of claim 1, further comprising:

d. a support base.

3. The water level management apparatus of claim 1, further comprising:

d. a discharge pipe.

4. The water level management apparatus of claim 1, further comprising:

d. a support base; and e. a discharge pipe.

5. The water level management apparatus of claim 1, wherein the attachment means for attaching the cylindrical water diverter to said baffle is cross support bars.

6. The water level management apparatus of claim 1, wherein the cylindrical water diverter is made of metal.

7. The water level management apparatus of claim 1, wherein the cylindrical water diverter is at least 3 feet in length and has a diameter of a least 1 foot.

8. The water level management apparatus of claim 1, wherein the cylindrical water diverter has a diameter of about 36 inches to about 72 inches.

9. The water level management apparatus of claim 1, wherein the cylindrical water diverter has a diameter of about 48 inches to about 54 inches.

10. The water level management apparatus of claim 1, wherein the riser has a diameter of about 24 inches to about 60 inches.

11. The water level management apparatus of claim 1, wherein the riser has a diameter of about 30 inches to about 36 inches.

12. A method for controlling beaver infestation in a body of water, comprising:

a. installing the water level management apparatus according to claim 1, in a body of water.

13. The method of claim 12, wherein the installed water level management apparatus does not create surface water current.

14. The method of claim 12, wherein the installed water level management apparatus does not create an audible sound of falling or trickling water.

15. The method of claim 12, wherein the installed water level management apparatus can prevent beavers from blocking water flow into the apparatus for a period of at least 1 year without the need for human intervention to unblock said apparatus.

* * * * *